US012435580B2

(12) United States Patent
Leung et al.

(10) Patent No.: US 12,435,580 B2
(45) Date of Patent: Oct. 7, 2025

(54) STABILIZER INCLUDING MODIFIED HELICAL WELLBORE STABILIZING ELEMENTS

(71) Applicant: Halliburton Energy Services, Inc., Houston, TX (US)

(72) Inventors: Philip Park-Hung Leung, Houston, TX (US); Michael John Strachan, Houston, TX (US); John Kenneth Snyder, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 371 days.

(21) Appl. No.: 17/336,922

(22) Filed: Jun. 2, 2021

(65) Prior Publication Data

US 2021/0381323 A1 Dec. 9, 2021

Related U.S. Application Data

(60) Provisional application No. 63/034,732, filed on Jun. 4, 2020.

(51) Int. Cl.
*E21B 17/10* (2006.01)
*E21B 19/24* (2006.01)

(52) U.S. Cl.
CPC ..... *E21B 17/1078* (2013.01); *E21B 17/10* (2013.01); *E21B 19/24* (2013.01); *E21B 17/1042* (2013.01)

(58) Field of Classification Search
CPC ..... E21B 17/10; E21B 17/1078; E21B 17/22
See application file for complete search history.

(56) References Cited

U.S. PATENT DOCUMENTS 4,549,613 A 10/1985 Case
6,666,267 B1 12/2003 Charlton
(Continued)

FOREIGN PATENT DOCUMENTS

CA 1154430 A 9/1983
CN 109555488 A 4/2019
(Continued)

OTHER PUBLICATIONS

Pastusek, P. E., "Stabilizer Selection Based on Physics and Lessons Learned," Society of Petroleum Engineers, IADC/SPE-189649-MS, 2018 IADC/SPE Drilling Conference and Exhibition, 10 pages.

*Primary Examiner* — Yong-Suk (Philip) Ro
(74) *Attorney, Agent, or Firm* — Benjamin Ford; Parker Justiss, P.C.

(57) ABSTRACT

Provided is a stabilizer for use in a wellbore. The stabilizer, in one example, includes a downhole tubular coupleable to a downhole conveyance in a wellbore. In accordance with this example, the stabilizer additionally includes two or more helical wellbore stabilizing elements extending radially outward from the downhole component, the two or more helical wellbore stabilizing elements shaped such that an annular flow area between leading edges of adjacent helical wellbore stabilizing elements and between trailing edges of adjacent helical wellbore stabilizing elements is variable along at least a portion of a length (L) of the two or more helical wellbore stabilizing elements, and such that an unobstructed axial flow path exists between the adjacent helical wellbore stabilizing elements along the length (L).

20 Claims, 12 Drawing Sheets

(56) References Cited

U.S. PATENT DOCUMENTS

| | | | | |
|---|---|---|---|---|
| 2011/0114338 | A1 | 5/2011 | Casassa et al. | |
| 2015/0275588 | A1 | 10/2015 | Trowbridge et al. | |
| 2019/0078399 | A1 | 3/2019 | Smith et al. | |
| 2019/0301250 | A1* | 10/2019 | Schlappy ..... | E21B 19/24 |

FOREIGN PATENT DOCUMENTS

| | | | |
|---|---|---|---|
| EP | 1650400 | A1 | 4/2006 |
| WO | 9105936 | A1 | 5/1991 |
| WO | 2018151718 | A1 | 8/2018 |

* cited by examiner

STABILIZER INCLUDING MODIFIED HELICAL WELLBORE STABILIZING ELEMENTS

CROSS-REFERENCE TO RELATED APPLICATION

This application claims the benefit of U.S. Provisional Application Ser. No. 63/034,732, filed on Jun. 4, 2020, entitled "MODIFIED HELICAL BLADE STABILIZERS," commonly assigned with this application and incorporated herein by reference in its entirety.

BACKGROUND

Wellbores are sometimes drilled into subterranean formations that contain hydrocarbons to allow recovery of the hydrocarbons. Some wellbore servicing methods employ wellbore tubulars that are lowered into the wellbore for various purposes throughout the life of the wellbore. Since wellbores are not generally perfectly vertical, stabilizers are used to maintain the wellbore tubulars aligned within the wellbore. Alignment may help prevent any friction between the wellbore tubular and the side of the wellbore wall or casing, potentially reducing any damage that may occur.

BRIEF DESCRIPTION

Figure 1:
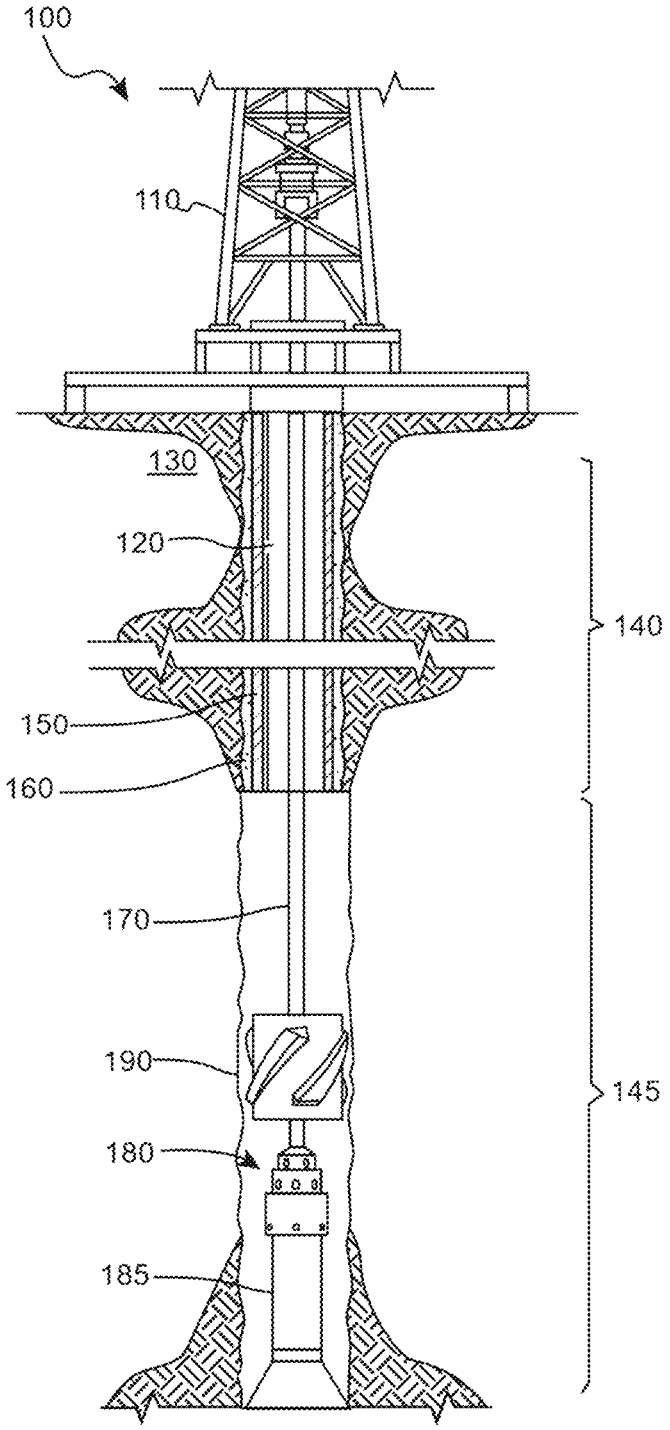

Reference is now made to the following descriptions taken in conjunction with the accompanying drawings, in which:

FIG. 1 illustrates a well system including an exemplary operating environment that the apparatuses, systems and methods disclosed herein may be employed; and FIGS. 2A-10 illustrate various different configurations for a stabilizer designed and manufactured according to the disclosure.

DETAILED DESCRIPTION

In the drawings and descriptions that follow, like parts are typically marked throughout the specification and drawings with the same reference numerals, respectively. The drawn figures are not necessarily, but may be, to scale. Certain features of the disclosure may be shown exaggerated in scale or in somewhat schematic form and some details of certain elements may not be shown in the interest of clarity and conciseness.

The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results. Moreover, all statements herein reciting principles and aspects of the disclosure, as well as specific examples thereof, are intended to encompass equivalents thereof. Additionally, the term, "or," as used herein, refers to a non-exclusive or, unless otherwise indicated.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the well; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical or horizontal axis. Unless otherwise specified, use of the term "subterranean formation" shall be construed as encompassing both areas below exposed earth and areas below earth covered by water, such as ocean or fresh water.

In certain situations, stabilizers are used throughout a downhole conveyance to centralize the downhole conveyance within a wellbore. The downhole conveyance will often be discussed herein as a drill string, but it should be known that the present disclosure is not so limited, and thus may be applied to any conveyance located within a wellbore. It is known that certain design parameters of stabilizers contribute to drill string dynamic behavior, including vibration, and whirl. The present disclosure recognizes, however, that the design of stabilizers must balance many conflicting parameters. Design parameters include but are not limited to taper (approach) angles, helical wellbore stabilizing element length (L), straight or spiral helical wellbore stabilizing elements, wrap angles, helical wellbore stabilizing element area, bypass area, base materials and coatings.

The present disclosure has further recognized that it is beneficial for the helical wellbore stabilizing elements to be shaped such that an annular flow area between leading edges of adjacent helical wellbore stabilizing elements and trailing edges of adjacent helical wellbore stabilizing elements is variable along at least a portion of the length (L) of the two or more helical wellbore stabilizing elements. In at least one embodiment, an unobstructed axial flow path exists between the adjacent helical wellbore stabilizing elements along the length (L). In at least one other embodiment, the helical wellbore stabilizing elements have a downhole longitudinal load line having a width ($W_{D1}$) greater than 1 mm located at a downhole leading edge of one of the two or more helical wellbore stabilizers, and an uphole longitudinal load line having a width ($W_{U1}$) greater than 1 mm located at an uphole trailing edge of another of the two or more helical wellbore stabilizers.

Referring to FIG. 1, illustrated is a well system 100 including an exemplary operating environment that the apparatuses, systems and methods disclosed herein may be employed. For example, the well system 100 could use a stabilizer according to any of the embodiments, aspects, applications, variations, designs, etc. disclosed in the following paragraphs. The well system 100 illustrated in FIG. 1 includes a rig 110 extending over and around a wellbore 120 formed in a subterranean formation 130. As those skilled in the art appreciate, the wellbore 120 may be fully cased, partially cased, or an open hole wellbore. In the illustrated embodiment of FIG. 1, the wellbore 120 is partially cased, and thus includes a cased region 140 and an open hole region 145. The cased region 140, as is depicted, may employ casing 150 that is held into place by cement 160.

The well system 100 illustrated in FIG. 1 additionally includes a downhole conveyance 170 deploying a downhole tool assembly 180 within the wellbore 120. The downhole conveyance 170 can be, for example, tubing-conveyed, wireline, slickline, drill pipe, production tubing, work string, or any other suitable means for conveying the downhole tool assembly 180 into the wellbore 120. In one particular advantageous embodiment, the downhole conveyance 170 is American Petroleum Institute "API" pipe, as might be used as part of a drill string.

The downhole tool assembly 180, in the illustrated embodiment, includes a downhole tool 185 and a stabilizer 190. The downhole tool 185 may comprise any downhole tool that could be positioned within a wellbore. Certain downhole tools 185 that may find particular use in the well system 100 include, without limitation, drilling and logging tools, rotary steerable tools, inline stabilizer tools, measurement or logging while drilling (MLWD) tools, mud motors and drill string stabilizers (e.g., collars with stabilizer blades), drill bits, bottom hole assemblies (BHAs), sealing packers, elastomeric sealing packers, non-elastomeric sealing packers (e.g., including plastics such as PEEK, metal packers such as inflatable metal packers, as well as other related packers), liners, an entire lower completion, one or more tubing strings, one or more screens, one or more production sleeves, etc.

The stabilizer 190, in accordance with one embodiment of the disclosure, includes a downhole component coupleable to the downhole conveyance 170. The downhole component may be a downhole tubular, a solid downhole stock, or a solid downhole stock having one or more fluid passageways extending along a length (L) thereof, among others, and remain within the scope of the present disclosure. The stabilizer 190, in accordance with this embodiment, additionally includes two or more helical wellbore stabilizing elements radially extending from the downhole component. In at least one embodiment, the stabilizer 190 includes four helical wellbore stabilizing elements radially extending from the downhole component. In at least one embodiment, the two or more helical wellbore stabilizing elements are shaped such that an annular flow area between leading edges of adjacent helical wellbore stabilizing elements and trailing edges of adjacent helical wellbore stabilizing elements is variable along at least a portion of a length (L) of the two or more helical wellbore stabilizing elements. In at least one embodiment, this is combined with the stabilizer having an unobstructed axial flow path between the adjacent helical wellbore stabilizing elements along the length (L), and in yet another embodiment, the stabilizer having a downhole longitudinal load line having a width ($w_1$) greater than 1 mm located at a downhole leading edge of one of the two or more helical wellbore stabilizers and an uphole longitudinal load line having a width ($w_2$) greater than 1 mm located at an uphole trailing edge of another of the two or more helical wellbore stabilizers, as well as combinations of the foregoing.

Figure 2A:
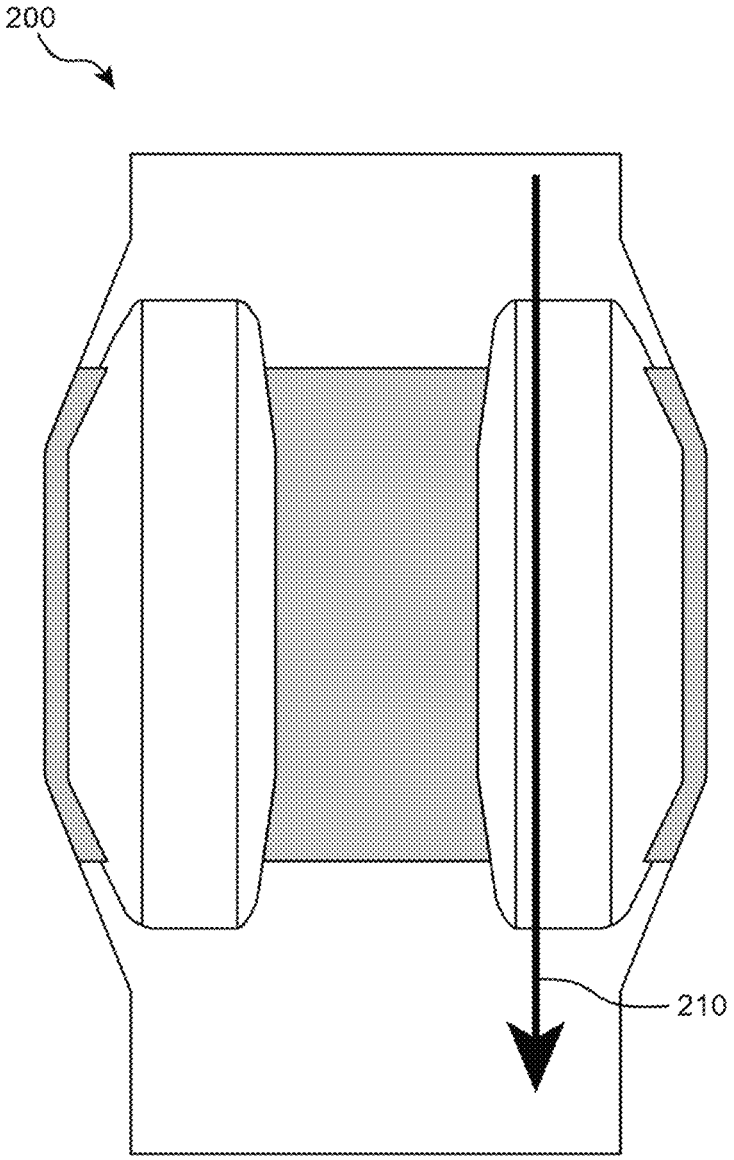
Figure 2B:
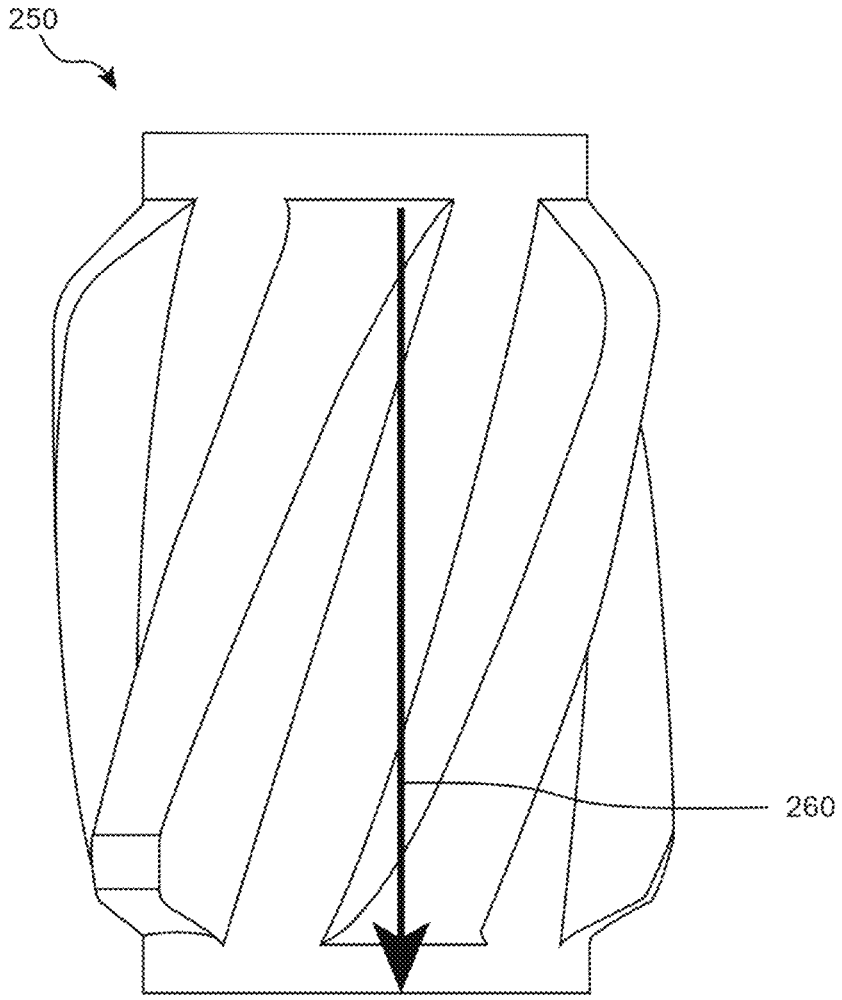
Figure 3A:
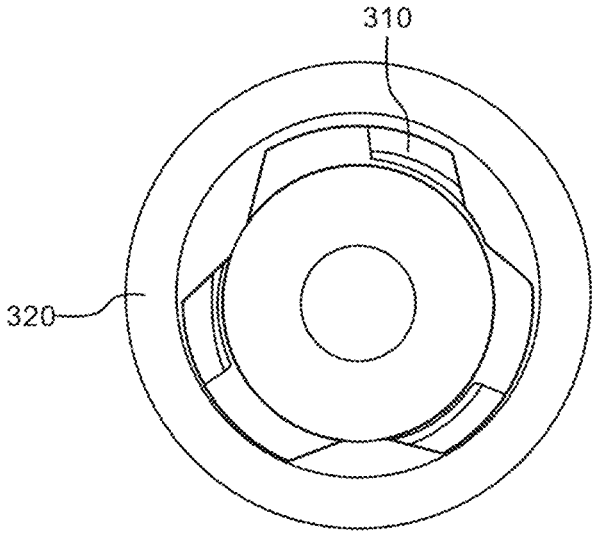
Figure 3B:
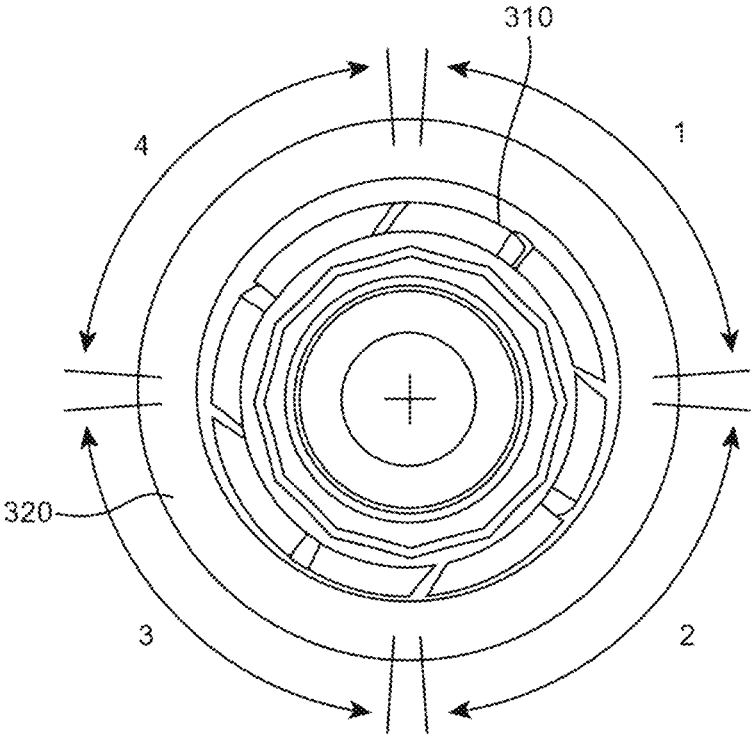

Compared to straight wellbore stabilizing element stabilizers 200 (e.g., as shown in FIG. 2A), helical wellbore stabilizing element stabilizers 250 (e.g., as shown in FIG. 2B) reduce drill string vibrations and stresses by ensuring that during rotation there is a minimal amount of rotation where the drill string is not supported. This is shown in FIGS. 3A and 3B, wherein the stabilizer 310 is positioned within a tubular, such as a wellbore 320. As shown, there is minimum amount of rotation wherein the stabilizer 310 is not supported by the tubular 320. FIG. 3B additionally illustrates the wrap angle, which in this embodiment is the sum 1+2+3+4, and as discussed below may be between 350 degrees and 360 degrees in certain embodiments.

The present disclosure has recognized that the localized contact pressure at the minimum contact length across the helical wellbore stabilizing elements in different angular orientations is reduced if four helical wellbore stabilizing elements are used compared to an equivalent stabilizer employing only three helical wellbore stabilizing elements. The reduced (e.g., localized) contact pressure is important to reduce friction, and prevent the stabilizer from penetrating into the wellbore, which in turn improves the wellbore, reduces vibration, and reduces stabilizer wear/damage. However, it is noted that stabilizers employing four helical wellbore stabilizing elements for hole sizes less than about 156 mm (e.g., about 6.125 inches) might not meet the flow area requirements, while maintaining sufficient helical wellbore stabilizing element thickness. In such scenarios, a stabilizer employing three helical wellbore stabilizing elements may be used. For larger stabilizers, a greater number of helical wellbore stabilizing elements may also be used to reduce contact pressure. Nevertheless, the present disclosure has recognized that certain designs of helical wellbore stabilizing elements can increase pressure losses in the annulus (required to move cuttings away from the blades) and may even trap cuttings resulting in increased erosion of the drill string and stabilizers.

A spiral stabilizer design would ideally balance the requirement for coverage or wrap angle with the requirement to ensure that there is an unobstructed axial flow path that exists between adjacent helical wellbore stabilizing elements along the length (L) of the spiral stabilizer design. This unobstructed axial flow path (e.g., also known as line of sight and shown by the arrows 210, 260 in FIGS. 2A and 2B, respectively) ensures that there is sufficient clearance for flow and cuttings while using the highest value of wrap angle to ensure that the stabilizer 200, 250 provides the drill string with support in all rotational positions. The present disclosure has further recognized that an additional complication of spiral stabilizers is that, particularly for sleeve type spiral stabilizers, stabilizers with high wrap angles can be difficult to install and or replace at the rig site as there is not a convenient location for the rig tongs to grasp the spiral stabilizer. The rig tongs are typically not used on the helical wellbore stabilizing element themselves, as they are typically coated with a hard wearing material such as coatings consisting of tungsten carbide, polycrystalline diamond compacts (PDC), and/or thermally stable polycrystalline (TSP) diamond or combination.

One novel design of the stabilizer shape maximizes the wrap angle, thereby reducing drill string vibrations and providing nearly full support for all rotational positions. Such a shape also, in certain embodiments, provides locations for clamping for installation. The stabilizer shape, in one embodiment, provides an annular flow area between leading edges of adjacent helical wellbore stabilizing elements and trailing edges of adjacent helical wellbore stabilizing elements that is variable along at least a portion of a length (L) of the two or more helical wellbore stabilizing elements, and further provides an unobstructed axial flow path between the adjacent helical wellbore stabilizing elements along the length (L).

The present disclosure has recognized, in least in one embodiment, instead of a standard helical spiral, the helical wellbore stabilizing element shape is a modified "Z" or "S" shape. In one embodiment, this is done by removing additional helical wellbore stabilizing element areas during machining of the helical wellbore stabilizing elements so that the unobstructed axial flow path (e.g., line of sight) can be maintained while having a high wrap angle (e.g., >350 degrees but less than 360 degrees).

Figure 4A:
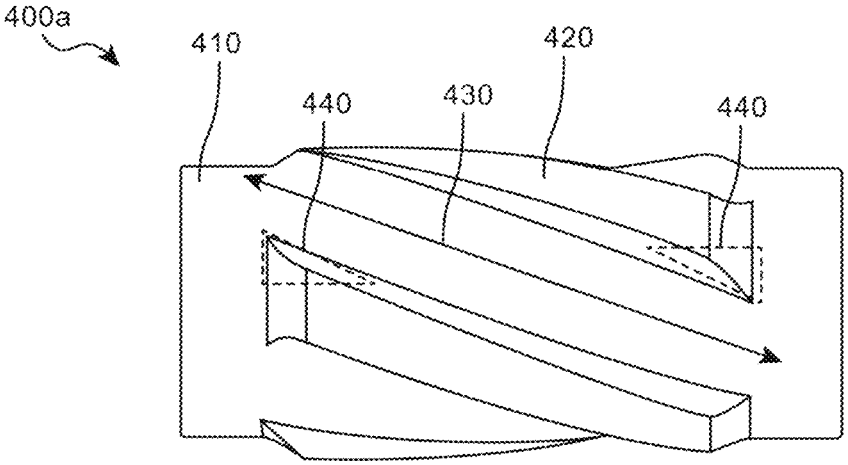
Figure 4B:
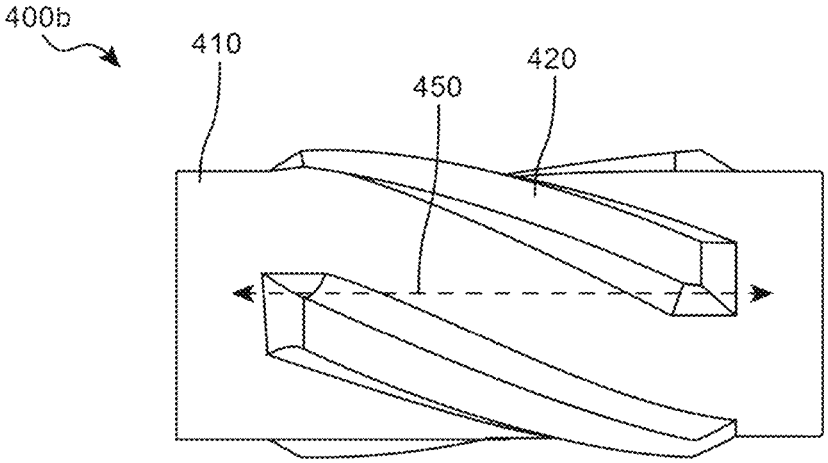
Figure 4C:
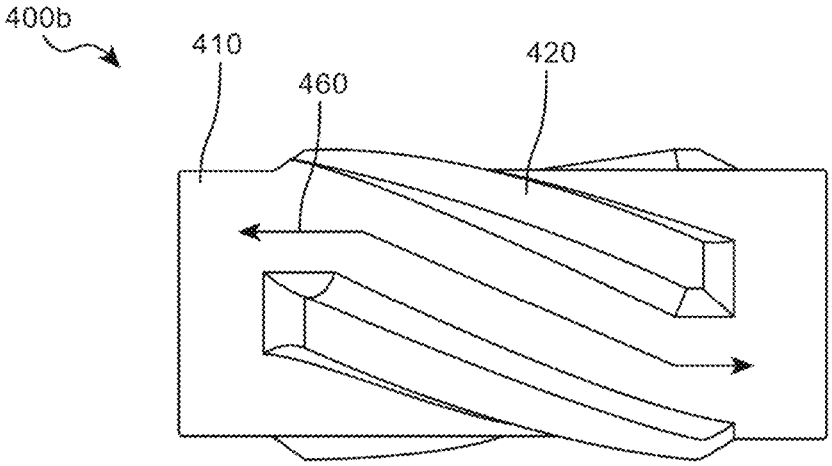

Turning to FIGS. 4A through 4C, illustrated is one embodiment for manufacturing a stabilizer 400 according to the disclosure. The stabilizer 400*a* begins with a downhole component 410 having two or more helical wellbore stabilizing elements 420 radially extending therefrom. As can be seen in FIG. 4A, a flow path centerline defined between adjacent helical wellbore stabilizing elements 420 is linear (e.g., as shown by the straight solid line 430). FIG. 4A additionally illustrates the areas to be removed from the stabilizer 400, the removed areas shown with the triangles 440, which could in turn provide the desired unobstructed axial flow path.

Turning to FIG. 4B, illustrated is the resulting stabilizer 400*b*, resulting in an unobstructed axial flow path (e.g., shown by the dotted line 450). Accordingly, as discussed above, the resulting wrap angle in certain embodiments may be greater than 350 degrees but less than 360 degrees. Turning to FIG. 4C, the stabilizer 400*b* is illustrated as now having a modified fluid flow path. In at least one embodiment, the flow path centerline defined between adjacent helical wellbore stabilizing elements is non-linear (e.g., as shown by the non-straight solid line 460). In at least one other embodiment, the flow path centerline defined between adjacent helical wellbore stabilizing elements is a modified "Z" or "S" shaped flow path centerline (e.g., as shown by the z-shaped solid line 460).

Figure 5A:
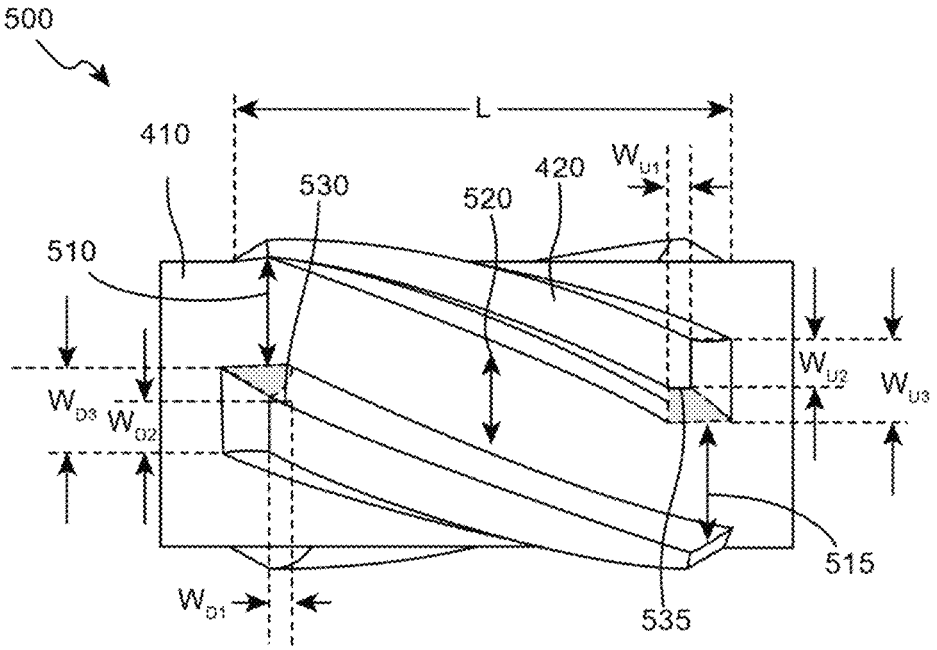
Figure 5B:
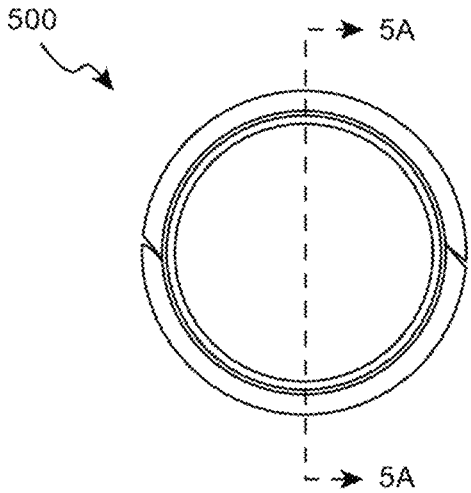
Figure 6A:
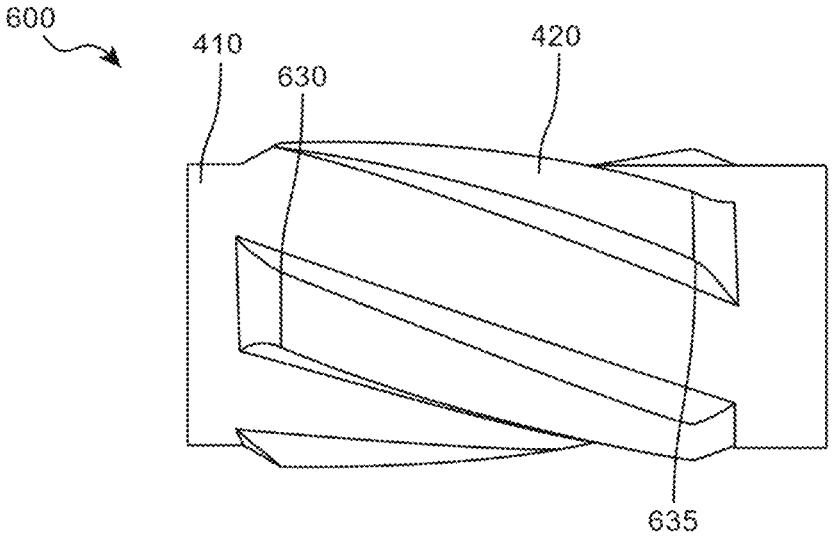
Figure 6B:
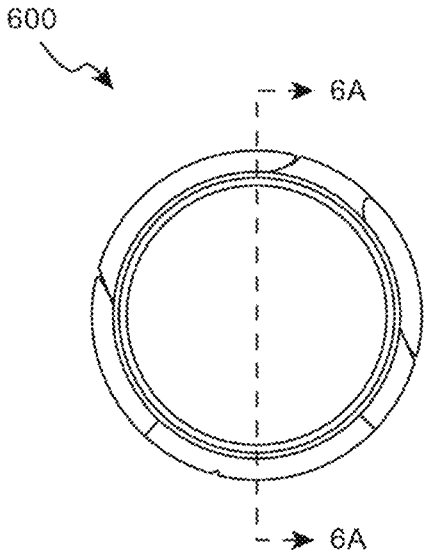

Turning to FIGS. 5A and 5B, as well as FIGS. 6A and 6B, illustrated are two different stabilizer designs 500, 600 each having the same gauge wellbore stabilizing elements and same length (L) helical wellbore stabilizing elements. FIGS. 5A and 5B illustrate different views of a stabilizer 500 employing the modified fluid flow path as discussed above with regard to FIGS. 4A through 4C, and maintaining the unobstructed fluid flow path. In contrast, FIGS. 6A and 6B illustrate different views of a stabilizer 600 not employing the modified fluid flow path as discussed above with regard to FIGS. 4A through 4C, but still maintaining the unobstructed fluid flow path. The stabilizers 500, 600 of FIGS. 5A through 6B are similar in many respects to the stabilizer 400, and thus also include the downhole component 410 and the two or more helical wellbore stabilizing elements 420.

The stabilizer 500 of FIGS. 5A and 5B includes the variable annular flow area along at least a portion of the length (L). For example, the annular flow path areas illustrated by the arrows 510 and 515 have a higher axial flow area than the annular flow path area illustrated by the arrow 520. According to one embodiment, a width of the annular flow path formed by adjacent helical wellbore stabilizing elements 420 is greater proximate the starting point and the end point of the helical wellbore stabilizing elements 420, and is lesser proximate a mid-point of the helical wellbore stabilizing elements 420, for example as a result of the shape of the adjacent helical wellbore stabilizing elements 420. A higher wrap angle is desired to ensure consistent drill string support throughout all rotational positions. The difference in wrap angle between the modified Z-helix stabilizer 500 shown in FIGS. 5A and 5B and standard helix stabilizer 600 shown in FIGS. 6A and 6B shows the most improvement with longer helical wellbore stabilizing element lengths and higher gauge sizes.

FIGS. 5A and 5B additionally illustrate that the modified helical wellbore stabilizers, may in one or more embodiments, each have a downhole longitudinal load line 530 located at a downhole leading edge thereof, and an uphole longitudinal load line 535 located at an uphole trailing edge thereof. In one or more embodiments, the downhole longitudinal load line 530 has a width ($W_{D1}$) greater than 1 mm and the uphole longitudinal load line 535 has a width ($W_{U1}$) greater than 1 mm. In one or more other embodiments, the downhole longitudinal load line 530 has a width ($W_{D1}$) greater than 2 mm and the uphole longitudinal load line 535 has a width ($W_{U1}$) greater than 2 mm. In yet one or more additional embodiments, the downhole longitudinal load line 530 has a width ($W_{D1}$) greater than 5 mm and the uphole longitudinal load line 535 has a width ($W_{U1}$) greater than 5 mm. The aforementioned downhole longitudinal load line 530 and uphole longitudinal load line 535, are in contrast to traditional stabilizer 600 of FIGS. 6A and 6B having a downhole point load 630 and uphole point load 635. Moreover, the aforementioned downhole longitudinal load line 530 and uphole longitudinal load line 535 need not be of similar width, but in certain embodiments they are of similar width. Additionally, the downhole longitudinal load line 530 and uphole longitudinal load line 535 need not be a straight line, and in certain other embodiments are a curved line.

Furthermore, the downhole longitudinal load line 530 and uphole longitudinal load line 535 need not be axially aligned with one another. In certain embodiments, the downhole longitudinal load line 530 and uphole longitudinal load line 535 are axially aligned with one another, in certain other embodiments the downhole longitudinal load line 530 and uphole longitudinal load line 535 are not axially aligned but overlap one another (e.g., such that an unobstructed axial flow path does not exist), and in yet other embodiments the downhole longitudinal load line 530 and uphole longitudinal load line 535 are not axially aligned but do not overlap one another (e.g., such that an unobstructed axial flow path does exist).

In accordance with one embodiment, the downhole longitudinal load line 530 and uphole longitudinal load line 535 create a distributed load area on the downhole leading edge of one of the two or more helical wellbore stabilizers and on the uphole trailing edge of another of the two or more helical wellbore stabilizers, respectively.

The stabilizer 500 illustrated in FIGS. 5A and 5B may additionally include a minimum downhole contact width ($W_{D2}$) and a downhole ramp width ($W_{D3}$), as well as a minimum uphole contact width ($W_{U2}$) and an uphole ramp width ($W_{U3}$). In at least one embodiment, as is shown, the minimum downhole contact width ($W_{D2}$) and the minimum uphole contact width ($W_{U2}$) are less than the downhole ramp width ($W_{D3}$) and uphole ramp width ($W_{U3}$), respectively. To achieve this design, a face of the removed portion might not be parallel with any plane formed through the centerline of the stabilizer. In at least one embodiment, the face is a flat surface, but is angled relative all planes formed through the centerline of the stabilizer. In yet another embodiment, such as that shown, the face is an arced surface (e.g., fillet or radius surface) that is not parallel with any plane formed through the centerline of the stabilizer 500.

The use of a stabilizer shape according to the disclosure could also address an issue related to the engaging and clamping of helical sleeve stabilizers. Helical sleeve stabilizers are typically used on motor assisted rotary steerable system (MARSS) motors and certain ILS or other stabilizers where it is desirable to change the gauge (outer diameter) size at the rig site. Because of the hard materials used on the helical wellbore stabilizing element faces, it is difficult to get rig tongs on the stabilizers without slipping or damaging the coating on the helical wellbore stabilizing element faces.

Figure 7A:
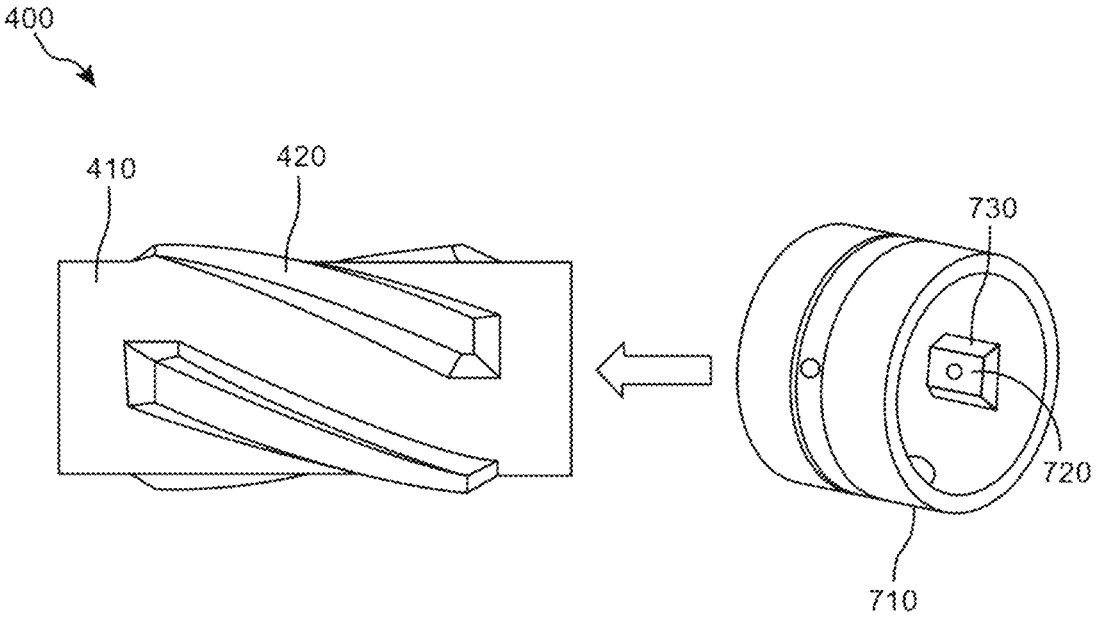
Figure 7B:
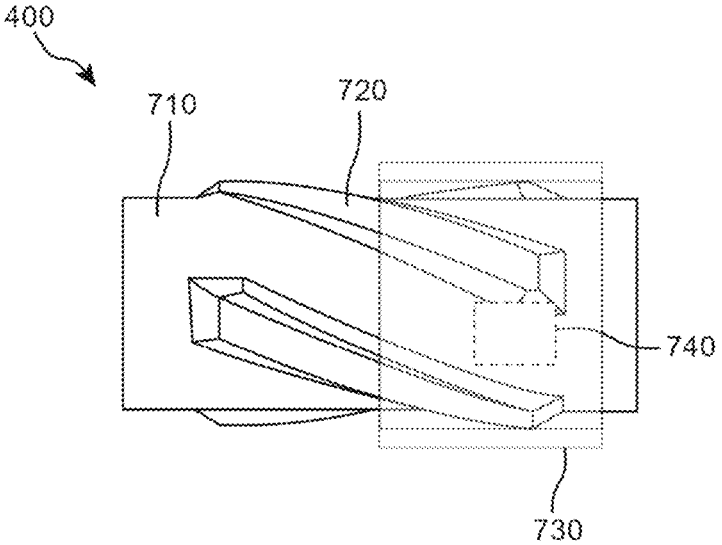

As shown in FIGS. 7A and 7B, a tubular rig tong 710 having associated protrusions 720 extending radially inward from an inner surface thereof, may be used to engage with and clamp upon the helical sleeve stabilizer 400. Specifically, as shown in FIG. 7B, the associated protrusions 720 may easily engage with the removed portion of the modified stabilizer 400, for turning and torqueing the helical sleeve stabilizer 400 relative to the tool/drill string, as shown in FIGS. 7A and 7B. In at least one embodiment, sidewalls 730 of the associated protrusions 720 are angled to substantially match any angle of the removed portions. In at least one other embodiment, sidewalls 730 of the associated protrusions 720 are not angled to match any angle of the removed portions.

Figure 8A:
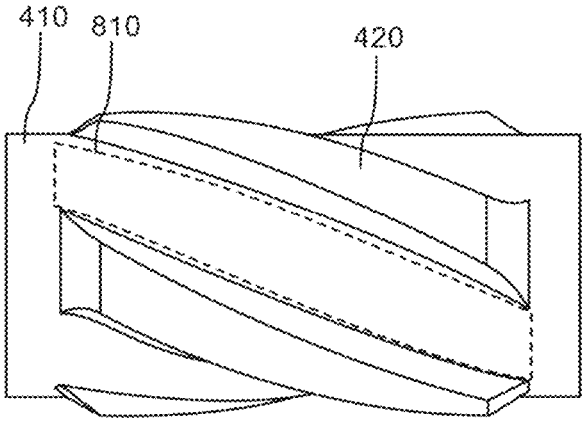

Traditional stabilizers are milled from billets or forgings by programming a helical area for the machinist to mill away to create the helical wellbore stabilizing elements 420 (e.g., see outlined area 810 in FIG. 8A). This new shape, in at least one embodiment, would involve an additional milling step to remove the areas highlighted after the helical wellbore stabilizing elements 420 have been cut (e.g., see the shaded leading face 820 and shaded trailing face 830 in FIG. 8B). In yet other embodiments, the shaded leading face 820 and shaded trailing face 830 are formed at the same time as the helical wellbore stabilizing elements 420.

Figure 8B:
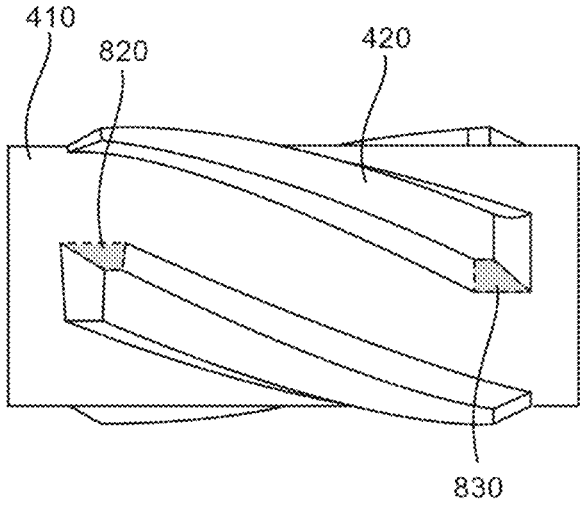
Figure 9:
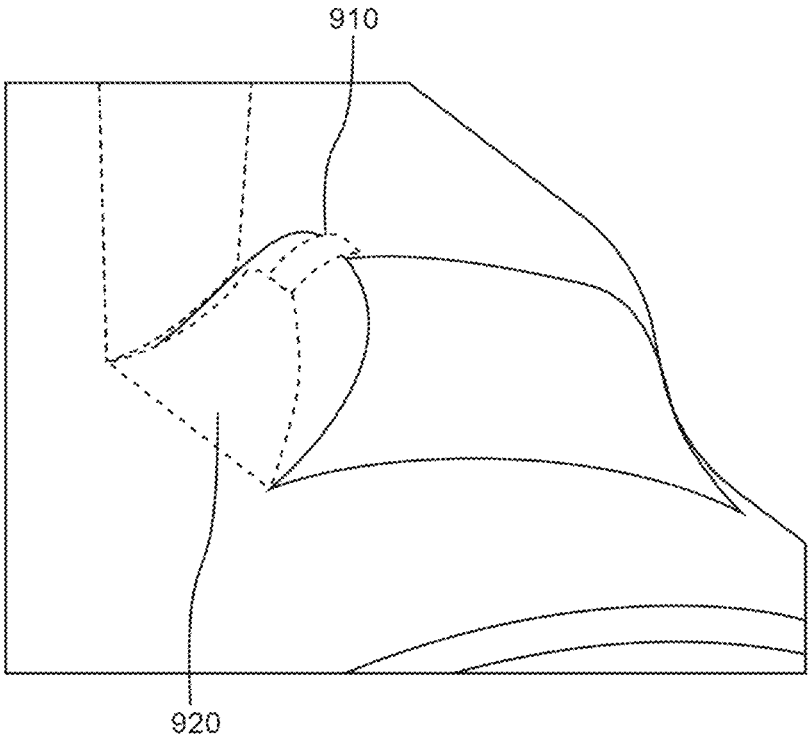

Turning to FIG. 9, illustrated is a close up of the modified areas (e.g., shaded leading face 820) shown in FIG. 8B. The curved profile on the outer edge (e.g., the dotted line 910) is intended to reduce vibrations and reduce stabilizer damage due to the borehole/blade interaction that would occur if the edge was square. The arced leading face 920 (e.g., fillet or radius shaped leading face), where the modification meets the body, is intended to reduce stress concentrations on the helical wellbore stabilizing element (again compared to a square corner) and for ease of manufacturability. The exact dimensions of these radius would be dependent on the final helical wellbore stabilizing element geometry (gauge size, bypass, etc.), thus the present disclosure should not be limited in any way.

Alternative methods of manufacture include additive manufacturing methods to directly generate (print) the helical wellbore stabilizing elements onto the downhole tubular (e.g., cylindrical base). Since in additive manufacturing methods, material is deposited in the exact locations defined by the part, it would be relatively simple to modify the printing (additive) program to not deposit material in the shaded areas 820 of FIG. 8B, thus creating the modified helical wellbore stabilizing element shape directly. Any final dimensions and tolerance could then be completed by standard machining methods if required. Other stabilizer creation methods that have been explored include flow forming, die extrusions and those can also be readily modified to generate this helical wellbore stabilizing element shape. The stabilizers would then be coated as per industry standard. The helical wellbore stabilizing element shapes may be prone to erosion so might be protected using coatings such as those containing hard materials like tungsten carbide and applied using methods like high velocity oxyacetylene spray, thermal spray, laser cladding, PTA and standard torch welding methods. The exact coating would be dependent on the substrate, final helical wellbore stabilizing element shape (for access) and available materials/processes.

Figure 10:
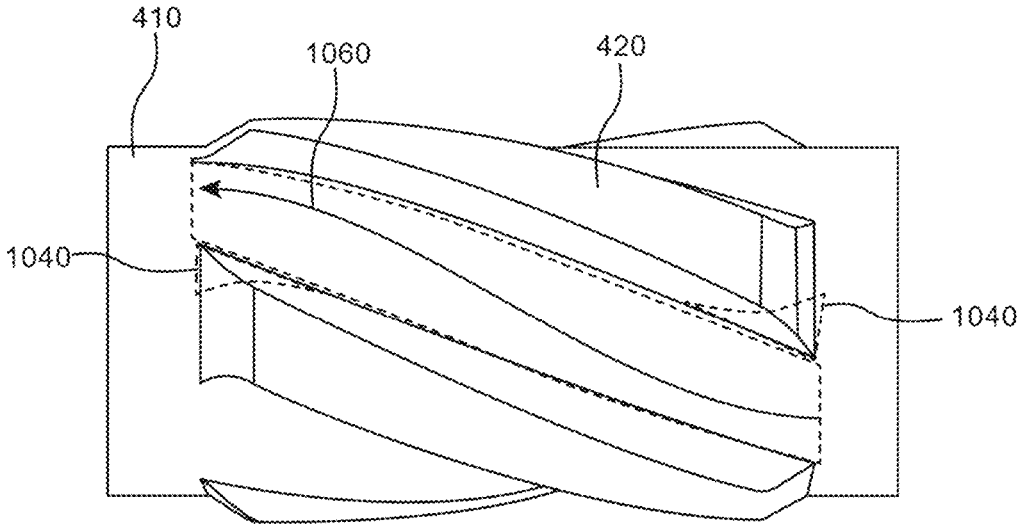

In many embodiments, the shape of the modified helix areas are straight and aligned with the axis of the tool. It is conceivable that these could also be curved (splined) or profiled so that the profile is more of an "S-shaped" flow path centerline instead of the elongated Z-shape flow path centerline shown. FIG. 10 illustrates a somewhat exaggerated version of this difference. The triangular pieces 1040 are what would be removed from the standard helix (the modification) and the arrow 1060 shows an exaggerated (for the purposes of this disclosure) flow path centerline. The exact shape would be refined based on analysis of expected erosion patterns and field testing to minimize the erosion on the helical wellbore stabilizing elements. Entrance and exit dimensions and shape do not have to match—the entrance could be triangular as shown by the triangle 440 in FIG. 4A, and the exit could be similar to the triangular piece 1040 in FIG. 10, or vice versa, among other designs.

Although stabilizers have been predominantly mentioned here in this disclosure, this modification to the helical wellbore stabilizing element profile could also be applied to reamers as well. Reamers are used to enlarge bore holes and this modification could be used in those applications as well to facilitate debris removal. Similarly, it should be noted that the term stabilizer as used herein is intended to encompass all types of stabilizers and centralizers as might be used in an oil/gas wellbore. Those skilled in the art to which this application relates will appreciate that other and further additions, deletions, substitutions and modifications may be made to the described embodiments.

Aspects disclosed herein include:

A. A stabilizer for use in a wellbore, the stabilizer including: 1) a downhole component coupleable to a downhole conveyance in a wellbore; and 2) two or more helical wellbore stabilizing elements extending radially outward from the downhole component, the two or more helical wellbore stabilizing elements shaped such that an annular flow area between leading edges of adjacent helical wellbore stabilizing elements and between trailing edges of adjacent helical wellbore stabilizing elements is variable along at least a portion of a length (L) of the two or more helical wellbore stabilizing elements, and such that an unobstructed axial flow path exists between the adjacent helical wellbore stabilizing elements along the length (L).

B. A well system, the well system including: 1) a wellbore; 2) a downhole conveyance located within the wellbore; and 3) a stabilizer coupled to the downhole conveyance, the stabilizer including: a) a downhole component coupled to the downhole conveyance in a wellbore; and b) two or more helical wellbore stabilizing elements extending radially outward from the downhole component, the two or more helical wellbore stabilizing elements shaped such that an annular flow area between leading edges of adjacent helical wellbore stabilizing elements and between trailing edges of adjacent helical wellbore stabilizing elements is variable along at least a portion of a length (L) of the two or more helical wellbore stabilizing elements, and such that an unobstructed axial flow path exists between the adjacent helical wellbore stabilizing elements along the length (L).

C. A stabilizer for use in a wellbore, the stabilizer including: 1) a downhole component coupleable to a downhole conveyance in a wellbore; and 2) two or more helical wellbore stabilizing elements extending radially outward from the downhole component, the two or more helical wellbore stabilizing elements shaped such that an annular flow area between leading edges of adjacent helical wellbore stabilizing elements and between trailing edges of adjacent helical wellbore stabilizing elements is variable along at least a portion of a length (L) of the two or more helical wellbore stabilizing elements, and such that a downhole longitudinal load line having a width ($W_{D1}$) greater than 1 mm is located at a downhole leading edge of one of the two or more helical wellbore stabilizers, and an uphole longitudinal load line having a width ($W_{U1}$) greater than 1 mm is located at an uphole trailing edge of another of the two or more helical wellbore stabilizers.

D. A well system, the well system including: 1) a wellbore; 2) a downhole conveyance located within the wellbore; and 3) a stabilizer coupled to the downhole conveyance, the stabilizer including: a) a downhole component coupled to the downhole conveyance in a wellbore; and two or more helical wellbore stabilizing elements extending radially outward from the downhole component, the two or more helical wellbore stabilizing elements shaped such that an annular flow area between leading edges of adjacent helical wellbore stabilizing elements and between trailing edges of adjacent helical wellbore stabilizing elements is variable along at least a portion of a length (L) of the two or more helical wellbore stabilizing elements, and such that a downhole longitudinal load line having a width ($W_{D1}$) greater than 1 mm is located at a downhole leading edge of one of the two or more helical wellbore stabilizers, and an uphole longitudinal load line having a width ($W_{U1}$) greater than 1 mm is located at an uphole trailing edge of another of the two or more helical wellbore stabilizers.

Aspects A, B, C and D may have one or more of the following additional elements in combination: Element 1: wherein the downhole component is a downhole tubular. Element 2: wherein adjacent helical wellbore stabilizing elements define a flow path centerline, and furthermore wherein the flow path centerline is non-linear. Element 3: wherein the flow path centerline is a modified z-shape or modified s-shape. Element 4: wherein each of the two or more helical wellbore stabilizing elements includes a minimum downhole contact width ($W_{D2}$), a downhole ramp width ($W_{D3}$), a minimum uphole contact width ($W_{U2}$), and an uphole ramp width ($W_{U3}$). Element 5: wherein the minimum downhole contact width ($W_{D2}$) and the minimum uphole contact width ($W_{U2}$) are less than the downhole ramp width ($W_{D3}$) and uphole ramp width ($W_{U3}$), respectively. Element 6: wherein a leading face and a trailing face of the two or more helical wellbore stabilizing elements are not parallel with any plane formed through a centerline of the stabilizer. Element 7: wherein the leading face and the trailing face are a flat leading face and a flat trailing face that are each angled relative all planes formed through the centerline of the stabilizer. Element 8: wherein the leading face and the trailing face are an arced leading face and an arced trailing face that are not parallel with any plane formed through a centerline of the stabilizer. Element 9: wherein the two or more helical wellbore stabilizing elements have a wrap angle greater than 350 degrees but less than 360 degrees. Element 10: wherein the downhole longitudinal load line has a width ($W_{D1}$) greater than 2 mm and the uphole longitudinal load line has a width ($W_{U1}$) greater than 2 mm. Element 11: wherein the downhole longitudinal load line has a width ($W_{D1}$) greater than 5 mm and the uphole longitudinal load line has a width ($W_{U1}$) greater than 5 mm. Element 12: wherein the downhole longitudinal load line and the uphole longitudinal load line have different widths. Element 13: wherein the downhole longitudinal load line and the uphole longitudinal load line are a straight downhole longitudinal load line and a straight uphole longitudinal load line. Element 14: wherein the downhole longitudinal load line and the uphole longitudinal load line are a curved downhole longitudinal load line and a curved uphole longitudinal load line. Element 15: wherein the two or more helical wellbore stabilizing elements are shaped such that an unobstructed axial flow path exists between the adjacent helical wellbore stabilizing elements along the length (L). Element 16: wherein adjacent helical wellbore stabilizing elements define a flow path centerline, and furthermore wherein the flow path centerline is non-linear.

Those skilled in the art to which this application relates will appreciate that other and further additions, deletions, substitutions and modifications may be made to the described embodiments.

What is claimed is:

1. A stabilizer for use in a wellbore, comprising:

a downhole component coupleable to a downhole conveyance in the wellbore; and two or more helical wellbore stabilizing elements extending radially outward from the downhole component and defining two or more flow paths having two or more flow path axes parallel with an axis of rotation of the downhole component, the two or more helical wellbore stabilizing elements shaped such that an annular flow area between leading edges of adjacent helical wellbore stabilizing elements and between trailing edges of the adjacent helical wellbore stabilizing elements is variable along at least a portion of a length (L) of the two or more helical wellbore stabilizing elements, and further wherein a first annular flow area at the leading edges of the adjacent helical wellbore stabilizing elements and a second annular flow area at trailing edges of the adjacent helical wellbore stabilizing elements are greater than a third annular flow area at middle of the adjacent helical wellbore stabilizing elements, and such the two or more flow path axes are unobstructed along an entire portion of the length (L).

2. The stabilizer as recited in claim 1, wherein the downhole component is a downhole tubular.

3. The stabilizer as recited in claim 1, wherein adjacent helical wellbore stabilizing elements define a flow path centerline, and furthermore wherein the flow path centerline is non-linear.

4. The stabilizer as recited in claim 3, wherein the flow path centerline is a modified z-shape or modified s-shape.

5. The stabilizer as recited in claim 1, wherein each of the two or more helical wellbore stabilizing elements includes a minimum downhole contact width ($W_{D2}$), a downhole ramp width ($W_{D3}$), a minimum uphole contact width ($W_{U2}$), and an uphole ramp width ($W_{U3}$).

6. The stabilizer as recited in claim 5, wherein the minimum downhole contact width ($W_{D2}$) and the minimum uphole contact width ($W_{U2}$) are less than the downhole ramp width ($W_{D3}$) and uphole ramp width ($W_{U3}$), respectively.

7. The stabilizer as recited in claim 6, wherein a leading face and a trailing face of the two or more helical wellbore stabilizing elements are not parallel with any plane formed through a centerline of the stabilizer.

8. The stabilizer as recited in claim 7, wherein the leading face and the trailing face are a flat leading face and a flat trailing face that are each angled relative all planes formed through the centerline of the stabilizer.

9. The stabilizer as recited in claim 7, wherein the leading face and the trailing face are an arced leading face and an arced trailing face that are not parallel with any plane formed through a centerline of the stabilizer.

10. The stabilizer as recited in claim 1, wherein the two or more helical wellbore stabilizing elements have a wrap angle greater than 350 degrees but less than 360 degrees.

11. A well system, comprising:

a wellbore;

a downhole conveyance located within the wellbore; and a stabilizer coupled to the downhole conveyance, the stabilizer including:

a downhole component coupled to the downhole conveyance in the wellbore; and two or more helical wellbore stabilizing elements extending radially outward from the downhole component and defining two or more flow paths having two or more flow path axes parallel with an axis of rotation of the downhole component, the two or more helical wellbore stabilizing elements shaped such that an annular flow area between leading edges of adjacent helical wellbore stabilizing elements and between trailing edges of the adjacent helical wellbore stabilizing elements is variable along at least a portion of a length (L) of the two or more helical wellbore stabilizing elements, and further wherein a first annular flow area at the leading edges of the adjacent helical wellbore stabilizing elements and a second annular flow area at the trailing edges of the adjacent helical wellbore stabilizing elements are greater than a third annular flow area at middle of the adjacent helical wellbore stabilizing elements, and such the two or more flow path axes are unobstructed along an entire portion of the length (L).

12. The well system as recited in claim 11, wherein the downhole component is a downhole tubular.

13. The well system as recited in claim 11, wherein adjacent helical wellbore stabilizing elements define a flow path centerline, and furthermore wherein the flow path centerline is non-linear.

14. The well system as recited in claim 13, wherein the flow path centerline is a modified z-shape or modified s-shape.

15. The well system as recited in claim 11, wherein each of the two or more helical wellbore stabilizing elements includes a minimum downhole contact width ($W_{D2}$), a downhole ramp width ($W_{D3}$), a minimum uphole contact width ($W_{U2}$), and an uphole ramp width ($W_{U3}$).

16. The well system as recited in claim 15, wherein the minimum downhole contact width ($W_{D2}$) and the minimum uphole contact width ($W_{U2}$) are less than the downhole ramp width ($W_{D3}$) and uphole ramp width ($W_{U3}$), respectively.

17. The well system as recited in claim 16, wherein a leading face and a trailing face of the two or more helical wellbore stabilizing elements are not parallel with any plane formed through a centerline of the stabilizer.

18. The well system as recited in claim 17, wherein the leading face and the trailing face are a flat leading face and a flat trailing face that are each angled relative all planes formed through the centerline of the stabilizer.

19. The well system as recited in claim 17, wherein the leading face and the trailing face are an arced leading face and an arced trailing face that are not parallel with any plane formed through a centerline of the stabilizer.

20. The well system as recited in claim 11, wherein the two or more helical wellbore stabilizing elements have a wrap angle greater than 350 degrees but less than 360 degrees.

* * * * *